United States Patent [19]

Lin

[11] Patent Number: 4,834,664

[45] Date of Patent: May 30, 1989

[54] SAFETY END-CONNECTOR USED FOR EXTENSION CORD

[76] Inventor: Mei-Mei Lin, Fl. 2, No. 10, Alley 10, Lane 53, Tung-Nan St., Hsinchu, Taiwan

[21] Appl. No.: 131,937

[22] Filed: Dec. 11, 1987

[51] Int. Cl.[4] ..... H01R 13/44

[52] U.S. Cl. ..... 439/145; 439/621; 439/622; 337/197; 337/198; 337/241; 337/265

[58] Field of Search ..... 439/135-140, 439/142-145, 621, 622; 337/197, 198, 241, 265

[56] References Cited

U.S. PATENT DOCUMENTS

| | | | |
|---|---|---|---|
| 2,462,934 | 3/1949 | Athey | 439/621 |
| 3,778,740 | 12/1973 | Gaia et al. | 337/265 |
| 4,257,659 | 3/1981 | Gibbs | 439/145 |
| 4,632,479 | 12/1986 | Jacobson | 439/145 |
| 4,684,914 | 8/1987 | Wu | 439/622 |
| 4,729,741 | 3/1988 | Peng | 439/135 |

*Primary Examiner*—P. Austin Bradley

[57] ABSTRACT

An improved safety end-connector used for extension cord includes: a circuit protection fuse, a detachable fuse box for easy inspection and replacement, two lead-in wires clamped firmly by a tail clamp of a base, a plurality of pairs of socket openings each pair of socket openings protected by a shutter slide, and an indicator lamp furnished for indicating the receptacle during night time or in a dark place, or serving as a trouble indicator.

4 Claims, 3 Drawing Sheets

SAFETY END-CONNECTOR USED FOR EXTENSION CORD

SUMMARY OF THE INVENTION

An improved safety end-connector used for extension cord, it is featured in that the improved receptacle has a circuit protection fuse, a detachable/attachable fuse box for easy inspection and replacement, the lead-in wires of the cord are clamped firmly by the tail clamp of the base, each pair of socket openings is protected by a shutter slide, an indicator lamp is furnished for locating out the receptacle during night time or in a dark place, also it functions, as a trouble indicator. This improved receptacle utilizes only a few simple parts, and it can be easily assembled, in addition, it is convenient and safe in use.

The socket is generally utilized as an electric power outlet port for supplying electric power to an electrical appliance, especially receptacles provided with plural pair of socket openings, they are widely adopted in household, industrial, and commercial use, since each receptacle can provide several pairs of socket openings for receiving several plugs at the same time, therefore, it is practical and convenient for daily life use. Though receptacles are so popularly utilized nowadays, there still exists shortcomings to be improved such as:

1. They comprises of many complex parts, and screws are utilized to assemble them into workable products, therefore, they are both labour and cost consuming.
2. The pole pieces of the socket are complex in shape, higher cost should be spent for producing them.
3. The clamping ends on pole pieces of the sockets frequently lose their resiliency due to contacting resistance heat or material fatigue, which leads to poor electric current conduction.
4. When power in not available from the receptacle, the trouble can not be identified immediately whether the trouble comes from the socket itself, the plug of the extension cord or the extension cord.

In addition, there are other shortcomings existed in the traditional receptacles, for example: the openings for the clamping ends on pole pieces of the sockets can easily be blocked up by unecessary plastic chips; the plastic receptacle base can be softened or even melted by high temperature produced by resistance heat, which increases the danger of fire as a result of the short-circuit therefrom; the openings for the clamping ends on pole pieces of the socket can easily accumulate dirts, also they provide passages for moisture going into the receptacle which may create electricity leakage the worst of all is the socket opening can be easily accessed by children, if metal objects such as hair pins or a paper clip is accidentally inserted into it by a child, electric shock to the child may cause injury or even fatality; and the lead-in wires of the power cord as they are connected to their respective conducting strips can be easily broken off from connection by a moderate pull, or gradually become loose, or insulations gradually become hardened and stripping-off due to built-up high temperature from resistance heat at the connecting points, the worst thing is the consequence of short-circuit.

The main object of the present invention is to provide an improved safety end-connector used for extension cord, which is featured in that by utilizing a base, a cover, flat conducting strips, a fuse, a fuse box, an indicator lamp, and shutter plates etc. parts through simple positioning and assembly, a novel, safe, and practical receptacle is created.

The next object of the present invention is to provide an improved safety end-connector used for extension cord, which is featured in that each individual, socket of the receptacle is protected by a fuse as it is connected to one of the conducting strip of the receptacle, also its fuse box can be easily detached/attached for fuse replacement or inspection.

The other object of the present invention is to provide an improved safety end-connector used for extension cord use, in which, the tail end of the base is provided with a lead-in wire clamp through the clamping action of this wire clamp and the retaining action of the cover, the lead-in wires of the extension cord are firmly fixed in the receptacle and good conducting efficiency at their connection points is secured therefrom.

One further object of the present invention is to provide an improved safety end-connector use for extension cord, of which, across the connection points of the lead-in wires and the conducting strips, it is provided with an indicator lamp by cramping method, said indicator lamp is utilized as a trouble indicator to help locating the spot where the trouble stems from a power failure, breaking down of the receptacle or, the plug of the extension cord, or the extension cord.

The further object of the present invention is to provide an improved safety end-connector used for extension cord, in which, each socket openings is provided with a shutter slide, when the receptacle is not in use, it is switched to close for preventing them from accumulating dirts or moisture, or causing electric shock injury or even death when a child accidentally inserts metal objects into them.

The present invention, an improved safety end-connector used for extension cord, will be best understood from the following description of embodiment when read in connection with the accompanying drawings.

Figure 1:
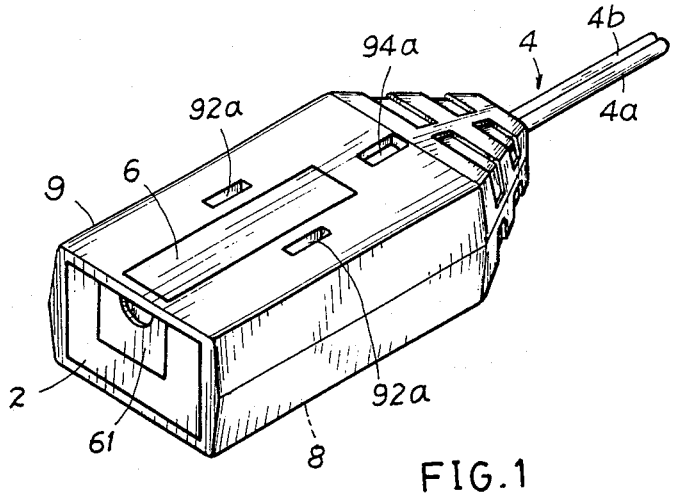
FIG.1 is the top side perspective view of the improved safety end-connector used for extension cord use of the present invention.
Figure 2:
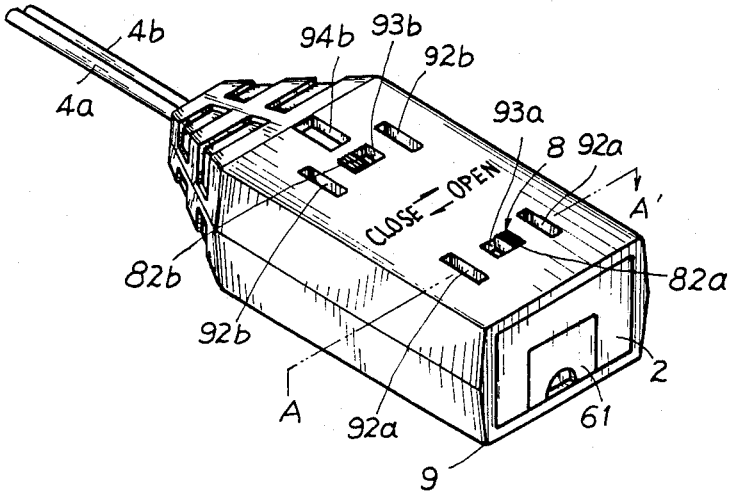
FIG. 2 is the bottom side perspective view of the improved safety end-connector used for extension cord use of the present invention.
Figure 3:
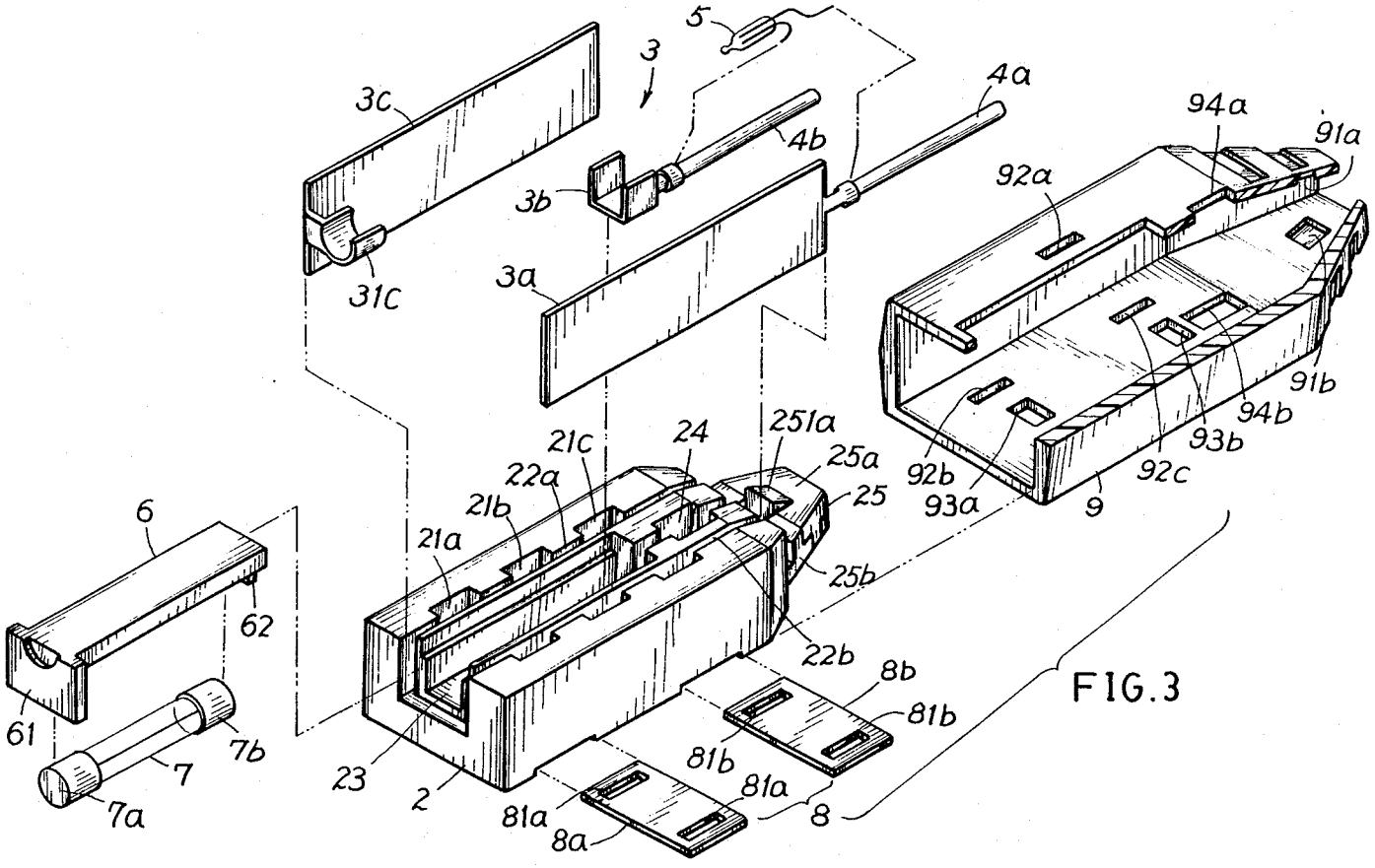
FIG. 3 is the exposed perspective view of the improved safety end-connector used for extension cord use of the present invention.

Refer to FIGS. 1, 2, and 3, the improved safety end-connector used for extension cord use of the present invention comprises: a base 2, conducting strips 3, two lead-in wires 4, an indicator lamp 5, a fuse box 6, a fuse 7, shutter slides 8, and a cover 9. In which, the base 2 is provided with plural pairs of socket openings 21*a*, 21*c* distributed uniformly at left and right sides of the base longitudinal axis, also in-line with the inner sides of these plural pairs of socket openings at both the left and right side of the base longitudinal axis, they are provided with a left and a right conducting strip troughs 22*a* and 22*b;* and inbetween these two conducting strip troughs 22*a* and 22*b,* it is provided with a fuse compartment 23 and an indicating through-hole 24; the tail end of the base is extended outwardly and formed into a tail clamp 25; the tail clamp 25 comprises of a bottom clamp 25*a* and a fastening clamp 25*b;* on top side of each pair of socket openings of the base 2, it is provided with respective depressed sliding ways 26*a* and 26*b;* the conducting strips 3 comprises of a positive pole conducting strip 3*a,* and a negative pole conducting strip 3*b* and an U-shaped positive pole fuse clip 3*c;* the conducting strip 3*a* and 3*b* are crampingly connected to their respective lead-in wires 4*a* and 4*b;* the left end of the conducting strip 3*c* is extended and bent leftward then formed into a fuse clip 31*c* which is installed in the left side conducting strip trough 22*a* of the base 2, while the positive and negative pole conducting strip 3*a* and 3*b,* are installed respectively in the right side conducting strip trough 22*b* and the rear end of the fuse compartment 23; the out extending portions of the lead-in wires from the base are clamped firmly by the bottom clamp 25*a* and fastening clamp 25*b* of the tail clamp 25 of the base 2, furthermore an indicator lamp 5 is crampingly connected to the connecting points between lead-in wires and the positive and negative pole conducting strips 3*a* and 3*b,* and it is housed in the indicating through-hole 24, the indicator lamp is filamentless type, it has an extended service time; the fuse box 6 has an integrated front panel 61 and a downward extended portion 62, the space between them is utilized for receiving a fuse 7, when a fuse is inserted therebetween and the fuse box 6 is pushed into the fuse compartment 23, the two conducting ends 7*a* and 7*b* of the fuse 7 will be engaged on the V-shaped positive pole fuse clip 3*c* and the fuse clip 31*c* on conducting strip 3*b,* in this way, a protective circuit is formed therefrom.

Figure 4:
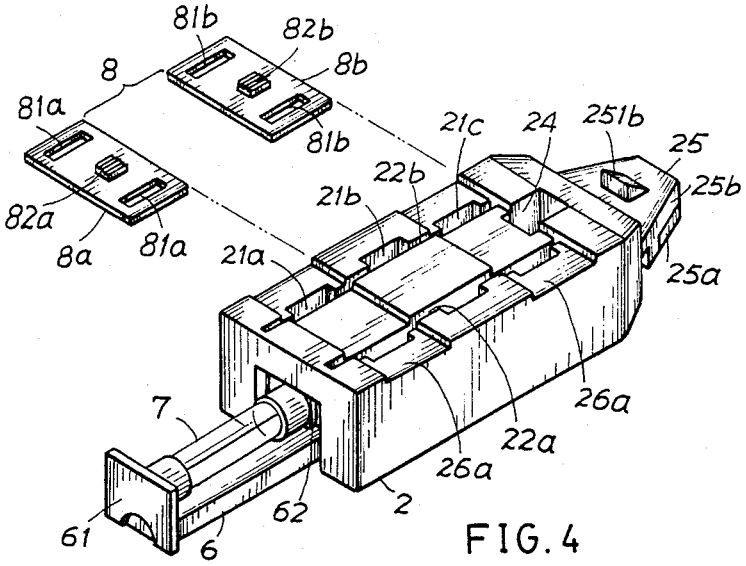
FIG. 4 is the perspective exposed view for the bottom side of the base, the shutter slides, the fuse, and the fuse box of the present invention.

Refer to FIG. 4, it can be seen that at each sliding way 26*a* and 26*b* on the top side of said base 2, they are provided with respective shutter slides 8*a* and 8*b,* on the shutter slides, they are provided with respective socket through-openings 81*a* and 81*b,* and poking bosses 82*a* and 82*b,* the socket through-openings 82*a* and 82*b* on each shutter slides 8*a* or 8*b* will be aligned with the pair of socket openings 21*a* or 21*c* underneath them on said base 2 when they are switched to an open position via the poking bosses 82*a* or 82*b.* After the abovesaid conducting strips 3, indicator lamp 5, fuse box 6, shutter slides 8 are all installed and positioned in the base 2, then is inserted into the cover 9, at this time, the protruded clipping pieces 251*a* and 251*b* at the tail end on both top and bottom sides of said base 2 will be clipped onto the clipping dent 91*a* and 91*b* at the rear end on both the top and bottom inner surfaces of said cover 9, in such manner, said base 2 and cover 9 can be positioned and connected together firmly; on the top side of said cover 9 at the corresponding locations with respect to said base 2, they are provided with multiple pair of socket through-openings 92*a* and 92*c* for receiving plugs, and multiple poking bosses through-openings 93*a* and 93*b* for switching the shutter slides 8*a* and 8*b* to their respective open or close positions via poking bosses 82*a* and 82*b,* also on both the top and bottom sides of said cover 9, they are provided with indicating windows 94*a* and 94*b* for viewing the light emitted form the indicator lamp 5.

Figure 5:
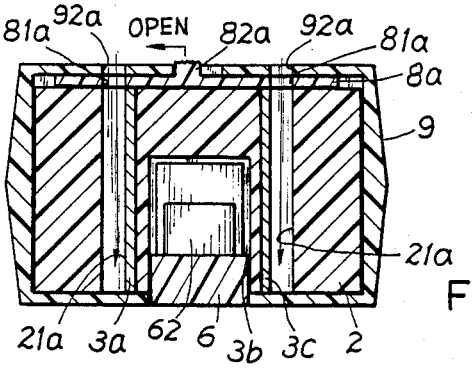
FIG. 5 is the sectional view at A—A of the improved safety end-connector used for extension cord use of the present invention, it also illustrates the switching action of the shutter slides.
Figure 6:
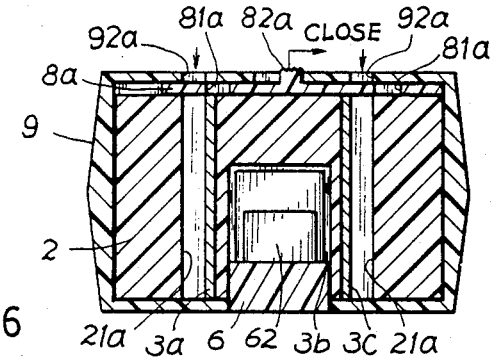
FIG. 6 is an illustration showing a closing shutter slides in accordance with the present invention.

When the fuse box 6 is installed with a fuse 7, and the fuse box 6 is pushed firmly into the fuse compartment, then the whole circuit of the extension cord and receptacle assembly is protected by the fuse 7 for safety, when said fuse 7 is blown out, any person can replace it without safety consideration, furthermore, when the plug end of the extension cord and the receptacle assembly is connected to the power source, the indicator lamp 5 will become lightened, especially in night time it indicates the location of the receptacle, also said indicator lamp 5 is utilized as a trouble indicator for trouble shooting, purpose such as: when the indicator lamp lights, but the sockets of the receptacle do not supply electric power, the trouble may come from a broken fuse or improper contact of the receptacle itself; if the indicator does not light, the trouble may come from the power failure, the cord, or its plug, in addition, such pair of socket openings on the receptacle can be switched to an open position when it is to be utilized (as shown in FIG. 5) by the poking boss 82*a* and 82*b* on said shutter slide 8*a* or 8*b* for receiving the plug of a electric appliance, or switched to close(as shown in FIG. 6) when it is not used for preventing it from cumulating dirts or moisture going in, whereby, the life time of the receptacles lenghtened and the electric safety is maintained; moreover, the lead-in wires of the cord is clamped firmly by the tail clamp 25 of said base 2 and it is further harnessed by the cover 9, therefore, they can not be easily pulled off from their connecting points.

For further explanations, the advantages of the improved safety end-connector used for extension cord use of the present invention are listed as follows:

1. It is simple in structure, can be easily assembled, it saves both man-hour and production cost, also it is safe and practical in use.
2. Plate conducting strips are adopted, in addition to its low production cost it also possisses a larger electric conducting surface.
3. It is protected by a fuse, therefore it is safe in use.
4. It is provided with an easy detachable/attachable fuse box, the inspection or replacement of the fuse can be easily achieved.
5. The lead-in wires of the cord is clamped down firmly by the tail clamp of the base and it is further held by the cover, and it can not be easily pulled off from their connecting points, whereby its service life is lengthened while its electric safety is maintained.
6. It is provided with a lamp light which emits light from both top and bottom sides of the receptacle for locating the receptacle during night time or in a dark place. It is also utilized as a trouble indicator for serving trouble shooting purpose.
7. Each pair of the socket openings are provided with respective shutter slides, so that when they are not in use, they can be switched to a close position for preventing them from cumulating dirts or moisture, or causing electric shock injury or fatality when a child unintentionally inserts metal objects into them.

What I claim is:

1. An improved safety end-connector used for extension cord comprising:

a base having a plural pair of socket openings of distributed uniformly on each side along of its longitudinal axis, a left and right side conducting strip troughs adjacent each of said socket openings, a fuse compartment and an indicating through-hole located between said conducting strip troughs, a rear portion of the base is extended out and formed into a tail clamp, a top surface provided with respective sliding ways for each pair of socket openings;

conducting strips comprising a flat negative pole conducting strip, a U-shaped positive pole fuse clip, and a flat positive pole conducting strip with one end extended and bent inwardly to form another fuse clip, after connection with respective lead-in wires of the extention cord, the flat negative conducting strip is place in one of the said left or right side conducting strip troughs, and the U-shaped positive pole fuse clip is placed in the rear end of the said fuse compartment, while the flat positive pole conducting strip with the fuse clip at one end is placed in another one of the unoccupied said left or right side conducting strip troughs with its fuse clip end located at the front end of the said fuse compartment;

an indicator lamp connected by a cramping method across the connecting points of the lead-in wires to the said negative pole conducting strip and the said positive pole fuse clip and housed in the said indicating through-hole on said base for serving both locating and trouble shooting purposes;

a fuse box having an integrated front panel and a downward extended rear piece for receiving a fuse easily detachable/attachable from/to the fuse compartment for fuse replacement or inspection;

a fuse placed in the said fuse box, when said fuse box is pushed into said fuse compartment, its two conducting ends will be clamped by the two said fuse clips for circuit protection; plural shutter slides provided with a respective pair of socket through-openings and protruding bosses for switching the respective pair of socket openings underneath it to an open or close position;

a cover provided with respective pairs of socket through-openings and openings for the protruding bosses and having top and bottom sides provided with respective indicating windows, the cover is utilized for housing and positioning of said base; whereby a receptacle is constructed and is protected and said fuse box can be easily detached/attached for fuse replacement or inspection, the pairs of socket openings can be switched to an open position or to a closed position with the indicator lamp serving both as a receptacle locating during night time or in a dark place, and for trouble shooting purposes.

2. An improved safety end-connector used for extension cord as set forth in claim 1, in which, the conducting strip troughs can be provided in-line with either the inner sides or the outer sides of the said pairs of socket openings for receiving the said conducting strips.

3. An improved safety end-connector used for extension cord as set forth in claim 1, in which, the tail clamp of the base comprises an intergrated bottom clamp and a fastening clamp, when these clamps are closed they apply uniform clamping force to both of the core and the insulation layer of the lead-in wire of the cord.

4. An improved safety end-connector used for extension cord as set forth in claim 1 or 3, in which protruded clipping pieces at the tail clamp end on both the top and bottom sides of the said base are clipped onto a clipping dent at the rear end on both the top and bottom inner surfaces of the cover for positioning said base and for harnessing the lead-in wires of the cord.

* * * * *